US006244776B1

(12) United States Patent
Wiley

(10) Patent No.: US 6,244,776 B1
(45) Date of Patent: Jun. 12, 2001

(54) APPLICATORS FOR HEALTH AND BEAUTY PRODUCTS

(76) Inventor: Lien J. Wiley, 2164 Brownstone Creek Ave., Simi Valley, CA (US) 93063

( * ) Notice: Subject to any disclaimer, the term of this patent is extended or adjusted under 35 U.S.C. 154(b) by 0 days.

(21) Appl. No.: 09/607,824

(22) Filed: Jun. 30, 2000

Related U.S. Application Data

(62) Division of application No. 09/002,590, filed on Jan. 5, 1998, now Pat. No. 6,126,352.

(51) Int. Cl.[7] ..... B05C 17/00

(52) U.S. Cl. ..... 401/208; 401/6; 401/219; 401/220; 401/183

(58) Field of Search ..... 401/208, 210, 401/220, 175, 185, 6, 209, 216, 218, 183; D4/122

(56) References Cited

U.S. PATENT DOCUMENTS

D. 299,972 * 2/1989 Moore ..... D4/122
D. 300,958 * 5/1989 Moore ..... D4/122
D. 363,377 * 10/1995 Koptis ..... D4/122
4,150,904 * 4/1979 Stewart ..... 401/186
4,811,726 * 3/1989 Goncalves et al. ..... 128/57
4,961,661 * 10/1990 Sutton et al. ..... 401/6
5,573,342 * 11/1996 Patalano ..... 401/175
5,810,027 * 9/1998 Frantzeskakis ..... 132/320

* cited by examiner

*Primary Examiner*—David J. Walczak
(74) *Attorney, Agent, or Firm*—Allen A. Dicke, Jr.

(57) ABSTRACT

The applicators for health and beauty fluid materials (or products) have an elongated reservoir with a dispenser head at one end and a telescoping extender thereon. When extended, the telescoping extender increases the length between the manual grasp and the dispenser head for application of the fluid material onto hard to reach body surface areas. The dispensing head lies at an acute angle to the handle length axis. The dispenser head has a rolling member and a cap which presses the rolling member down to close the dispensing opening through the dispenser head. The rolling member may be a roller, a cone or one or more spheres.

14 Claims, 4 Drawing Sheets

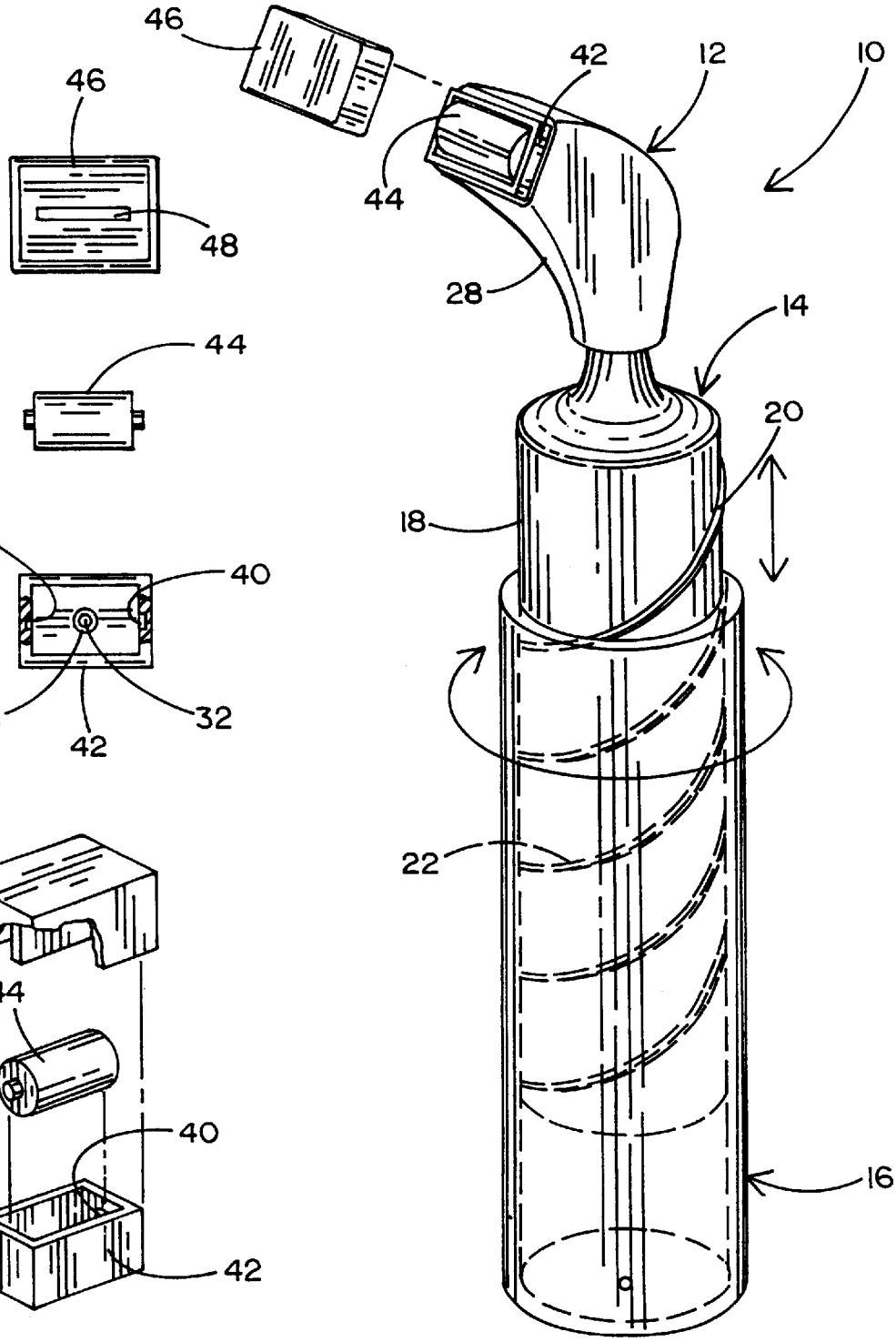
FIG. 1
FIG. 3
FIG. 4
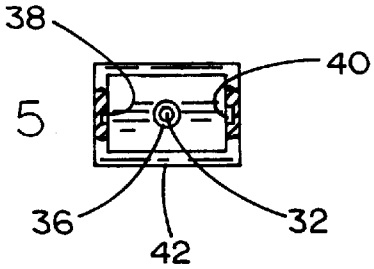
FIG. 5
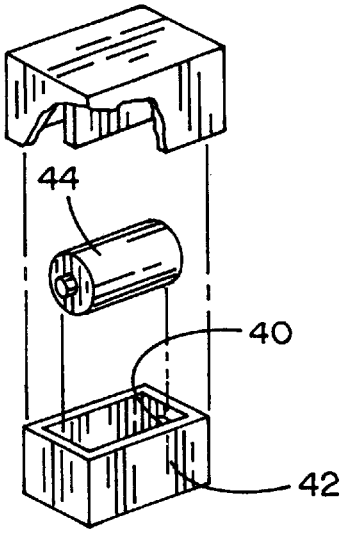
FIG. 2

APPLICATORS FOR HEALTH AND BEAUTY PRODUCTS

CROSS-REFERENCE

This application is a division of patent application, Ser. No. 09/002,590, filed on Jan. 5, 1998, now U.S. Pat. No. 6,126,352, granted Oct. 3, 2000.

FIELD OF THE INVENTION

The applicator is for fluid materials of all viscosities and has an angular dispensing head for conveniently reaching difficult body surfaces. The fluid material reservoir serves as a handle and the handle has an extension thereon to reach more distant application points.

PRIOR ART

In the original application, Ser. No. 08/641,892, filed May 2, 1996, the Examiner cited Stephens U.S. Pat. No. 824,752; Peeples U.S. Pat. No. D252,219; and Fitzpatrick U.S. Pat. No. 5,816,619.

BACKGROUND OF THE INVENTION

Various lotions of medication and various lotions of materials used as health and beauty products are applied to the skin for various health and beauty purposes. These lotions are generally liquid, gels or are of fluid consistency and may vary in consistency from almost-liquid to almost-solid. The applicator is useful for lotions, creams, oils, moisturizers, liquid lipsticks, liquid make-up, eye make-up, as well as therapeutic materials of that general consistency or the like without touching the material and the skin.

The application of such materials is difficult to achieve. Quite often the materials are applied to the hand, but the concave shape of the palm of the hand prevents even coating of the skin. The fluid material is spread from the palm of the hand onto the area to which it is to be applied. Unless great care is taken, when applied from the palm of the hand, the spreading is uneven. It must be noted that it is usually not intended that this material be applied to the palm of the hand, but that is merely a way of conveying the fluid material to the skin area to which it is to be applied. There is loss because that material remaining in the palm of the hand is washed away. There is an additional problem of having the fluid material deposited in the rings being worn by the user. If the ring is taken off, it may be left behind and lost. If the ring is left on, it will be filled with the fluid material and must be regularly cleaned. Thus, the present method of applying the fluid material by application from the hand is undesirable. Furthermore, the roller of the applicator helps the fluid material to penetrate into the skin effectively and evenly.

SUMMARY OF THE INVENTION

In order to aid in the understanding of this invention, it can be stated in essentially summary form that it is directed to an applicator for health and beauty products which are of many consistencies. The applicator comprises a reservoir which also serves as a handle for manipulation of the applicator. The handle may be extensible for longer length to permit a longer reach. The angular dispensing head on the applicator has a rolling member therein. When the applicator is manipulated, the rolling member rolls against the skin. The reservoir delivers the fluid material to the rolling member so that it is applied to the desired area of the skin surface.

It is thus a purpose and advantage of this invention to provide an improved applicator for health and beauty products which insures smooth and even distribution of the material to the selected body area.

It is a further purpose and advantage of this invention to provide an applicator which includes a reservoir from which health and/or beauty products of fluid consistency are dispensed to an angular head with a rolling member so that the rolling member is placed in contact with the skin to apply the material.

It is another purpose and advantage of this invention to provide a length extender for the material reservoir so that the angular dispensing head can be positioned farther away from the manipulating end so that the fluid material can be applied to the selected body area.

It is a further purpose and advantage of this invention to provide an applicator which is easy to manufacture so that it may inexpensively employed for application for a variety of different health and beauty products of many consistencies.

These and other purposes and advantages of this invention will become apparent from the study of the following portion of this specification, taken in conjunction with the accompanying drawings.

BRIEF DESCRIPTION OF THE DRAWINGS

FIG. 1 is a perspective view of a first preferred embodiment of an applicator in accordance with this invention.

FIG. 2 is an exploded view of the roller mounting and cap of the angular dispensing head.

FIG. 3 is an under view of the cap.

FIG. 4 is a side view of the dispensing roller.

FIG. 5 is a plan view of the dispensing head showing the roller basket with opening in the bottom.

DESCRIPTION OF THE PREFERRED EMBODIMENT

Figure 6:
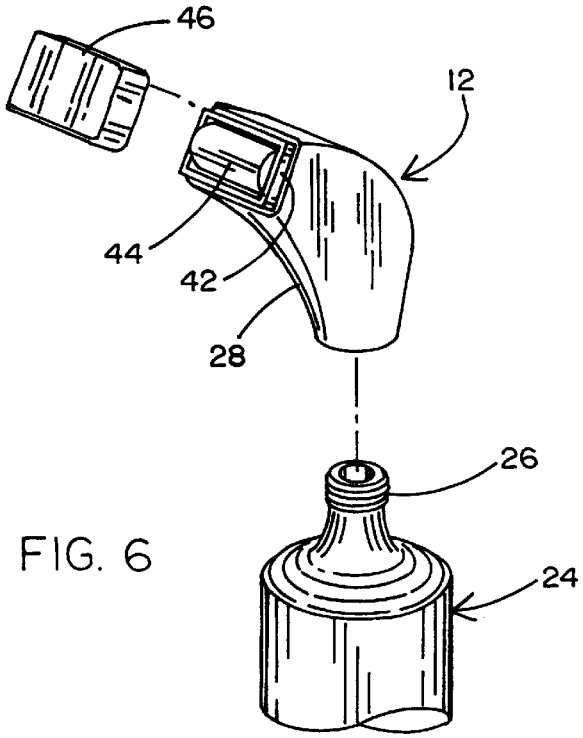
FIG. 6 is a perspective view of the preferred embodiment of the dispensing head attached to a different reservoir.

FIG. 1 shows an applicator 10 which is the first preferred embodiment of the applicator for health and beauty products in accordance with this invention. The applicator 10 comprises a dispenser head 12 mounted upon reservoir 14. The reservoir 14 carries a telescoping extender 16. Reservoir 14 has a cylindrical principal outer body surface 18 which defines an axis which carries screw threads 20. Telescoping extender 16 is a cylindrical tube with an interior diameter sized to fit over the surface 18. The interior of the telescoping extender has screw threads 22 which engage with the screw threads 20. By rotating the telescopic extender around its central cylindrical axis, the telescopic extender moves up and down on the reservoir. In the closed, upper position, the reservoir plus extender are short for packaging and storage. When the telescoping extender is screwed down, the entire structure is lengthened so that when manually held, the dispensing head 12 can reach those parts of the body which are sometimes difficult to reach, such as the center of the user's back. The telescoping extender can be extended downward to a stop formed by stop faces in both of the thread surfaces. The stop is engaged when the telescoping extender is extended to its maximum practical length. From the maximum extended position, the extender can be screwed upwardly to the point where the bottom of the extender is even with the bottom of the reservoir. The axis and rotation of the extender corresponds to the central axis of the reservoir to define the general length orientation of the reservoir with its extender which is its axis.

The dispensing head 12 is also seen in FIG. 6 where it is in projected position with respect to reservoir 24. The reservoir 24 has a screw-threaded nozzle 26 onto which the dispensing head 12 is attached. The dispensing head has corresponding screw threads on its interior so that it may be attached and detached from the reservoir, as required.

Figure 7:
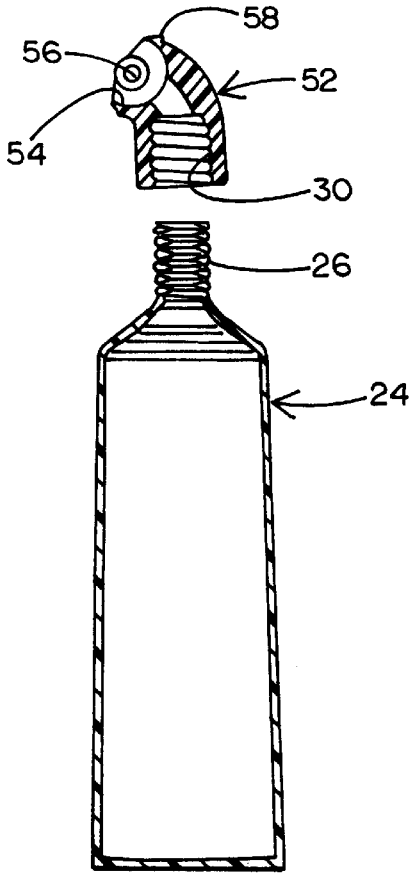
FIG. 7 is a center line section through a second embodiment of the dispenser head similar to the applicator of FIG. 6.

The dispensing head 12 has a body 28 which has interior screw threads by which it is attached to the reservoir. FIG. 7 shows a similar dispensing head 52 which has interior screw threads 30. The interior screw threads 30 are attached on the threaded nozzle 26 on reservoir 24, as shown in FIG. 7. The attachment of dispensing head 52 is similar to that of dispensing head 12. The screw threads in the dispensing head body define an axis on which the dispensing head is attached onto the reservoir. The dispensing head body has an interior passage there through which terminates in dispensing opening 32 in basket 42 having end walls and side walls. The dispensing opening has a toroidal ridge 36 therein. Each end of the basket has a cradle, with cradles 38 and 40 seen in FIG. 5. These cradles are seen in FIG. 5 by virtue of the end walls of roller basket 42 being partly broken away to expose these cradles. The cradle 40 is seen in FIG. 2. The basket 42 may be separately molded from the rest of body 28, but is preferably permanently inserted therein.

Dispensing roller 44 fits into the pocket in the roller basket and the end studs on the dispensing roller fit into the cradles to retain the roller in place. However, the cradles are not circular but are in the form of short slots parallel to the walls of the basket 34 so that the dispensing roller 44 can move toward and away from the dispensing opening 32. The roller 44 can move sufficiently away from the dispensing opening to permit dispensing of the fluid material in the reservoir onto the underside of the roller. Upon moving the roller across the skin surface, the roller rolls and the fluid material is dispensed. When dispensing is complete, cap 46 can be placed over the roller 44 and over the front edges of the roller basket 42. Interior wall 48 is a stop wall which presses on the roller 44 and presses it down against the toroidal ridge 36 to terminate dispensing. The cap can resiliently snap off and on, as is conventional.

It is important to note that the front of the roller basket 42 is planar. A line perpendicular to that plane intersects the axis of the reservoir with about a 60 degree included acute angle. When the dispensing roller 44 is engaged against a flat surface for application of material therein, the axis of the reservoir and telescopic extension of the reservoir lies about 60 degrees above the surface to which the material is being applied. This permits convenient application by holding the reservoir or telescopic extender in the hand. When the applicator bottle 20 is held sideways at a high angle and the rolling member rolls on skin, the material from the reservoir is gravitationally driven. Furthermore, a squeeze on the applicator bottle gives pressure enabling the fluid to flow to the applicator head and dispensing roller ready for use.

Figure 8:
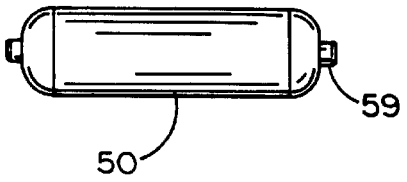
FIG. 8 is a side view of a second embodiment of the dispensing roller, which is used in the head of FIG. 7.

The dispensing head 12 is shown on reservoir 24 in FIG. 6. The dispensing head 12 is the same as that shown in FIGS. 1–5. The reservoir 24 is a flexible reservoir, such as may be made from synthetic polymer composition material so that the fluid material within the reservoir may be dispensed by squeezing the reservoir 24. Roller 50 is shown in FIG. 8. The roller 50 is the same as the roller 44, except that it has substantially hemispherical ends. The basket 54 in the dispensing head 52 is sized and shaped to receive the roller 50, in the manner similar to that described above for roller 44. The slotted cradle 56 receives the stud 59 on the end of roller 50, as previously described. The scale of FIG. 8 shows the roller 50 too large to fit within basket 54, but in actual manufacture the roller 50 would be properly sized to go into that basket. Dispensing head 52 is of simpler construction than dispensing head 12 because there are no separate roller baskets involved. However, rib 58 around the basket permits removable mounting of a cap similar to cap 46.

Figure 9:
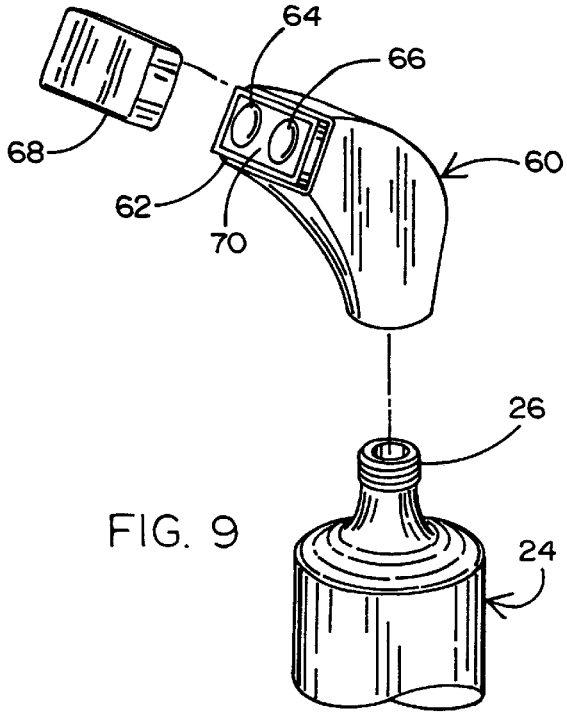
FIG. 9 is a view similar to FIG. 6 but showing the dispensing head with two spherical applicator balls therein.

FIG. 9 shows a reservoir 24 which is flexible so that it can be squeezed to press out the contents. The dispensing head 60 is the same as the dispensing head 12 except that the roller basket 62 inserted therein has two dispensing balls 64 and 66. There is a dispensing opening in the roller basket 62 under each of the dispensing balls. Cap 68 has a stop above each of the dispensing balls so that when the cap is in place over the roller basket, the dispensing balls are pressed back to close the dispensing openings. The dispensing balls can be retained in place by means of a cover plate 70 which has an opening through which a portion of each of the dispensing balls extends. The cover plate thus acts as a keeper plate for the balls. More than two balls can be utilized.

Figure 10:
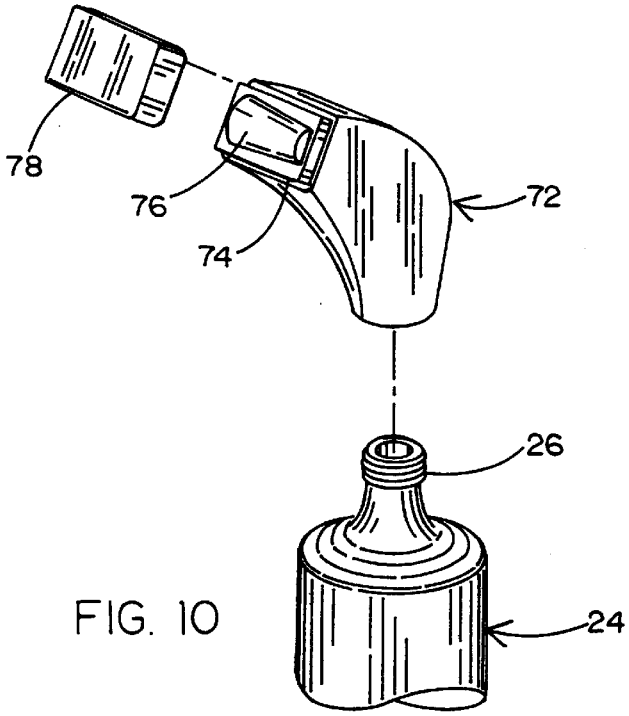
FIG. 10 is a view similar to FIG. 9 but showing the dispensing head with a truncated conical dispensing roller.

FIG. 10 shows the dispensing head 72 attachable by screw threads 26 to the reservoir 24. Dispensing head 72 contains a roller basket 74 which contains a roller 76 in the form of a truncated cone. The truncated cone is constrained by the cover plate on the roller basket. Cap 78 fits down over the truncated conical roller and presses against its corresponding dispensing opening to close the dispensing opening when the structure is not in use. Each of the dispensing heads thus far described holds the dispensing face at an appropriate angle so that when its roller is dispensing the fluid material onto a surface, the reservoir and/or telescoping extender are positioned above the surface for convenient handling.

Figure 11:
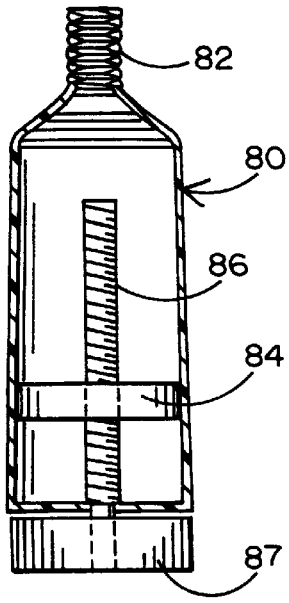
FIG. 11 is a center line section through the reservoir, similar to FIG. 7, but showing a different means for expelling the fluid material from the reservoir.

Reservoir 80 shown in FIG. 11 has screw threads 82 by means of which any of the dispensing heads 12, 52, 60 or 72 can be attached. The reservoir 80 contains fluid material of the type previously described. The fluid material is dispensed out of the screw-threaded nozzle 82 by means of a piston 84 which lies within the reservoir. The piston 84 is raised by screw-threaded lead screw 86 which is threaded through the piston. Dial 87 is secured to the lead screw so that rotation of the dial moves the piston 84 upward to move the fluid material there above upward for dispensing. Any one of the dispensing heads can be attached to the upper portion of the reservoir.

Figure 12:
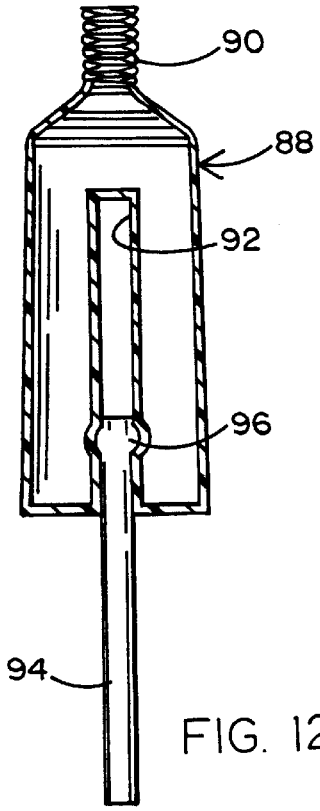
FIG. 12 is a substantially center line section through another preferred embodiment of the reservoir showing the extension length of the reservoir to be accomplished by means of a center telescopic extender.

Reservoir 88, shown in FIG. 12, also has a screw-threaded nozzle 90 onto which any one of the dispensing heads can be attached. Reservoir 88 has an interior tube 92 which is open to the bottom of the tube, opposite the threaded nozzle. Telescoping extender 94 is in the form of a rod which is slidably mounted in the interior tube. The telescoping extender can be telescoped nearly fully into the interior tube 92, and can be pulled out to the stop position shown in FIG. 12. The stop position is achieved by means of a stop 96 on extender 94 engaging against a corresponding stop shoulder in the interior tube. In this way, the applicator formed of reservoir 88 with a dispensing head thereon can be extended by pulling out the telescoping extender. This permits application to difficult to reach body areas, such as the center of the back. Each of these applicator structures permits the application of the fluid health or beauty product to the surface which is farther away than a hand can normally reach.

Figure 13:
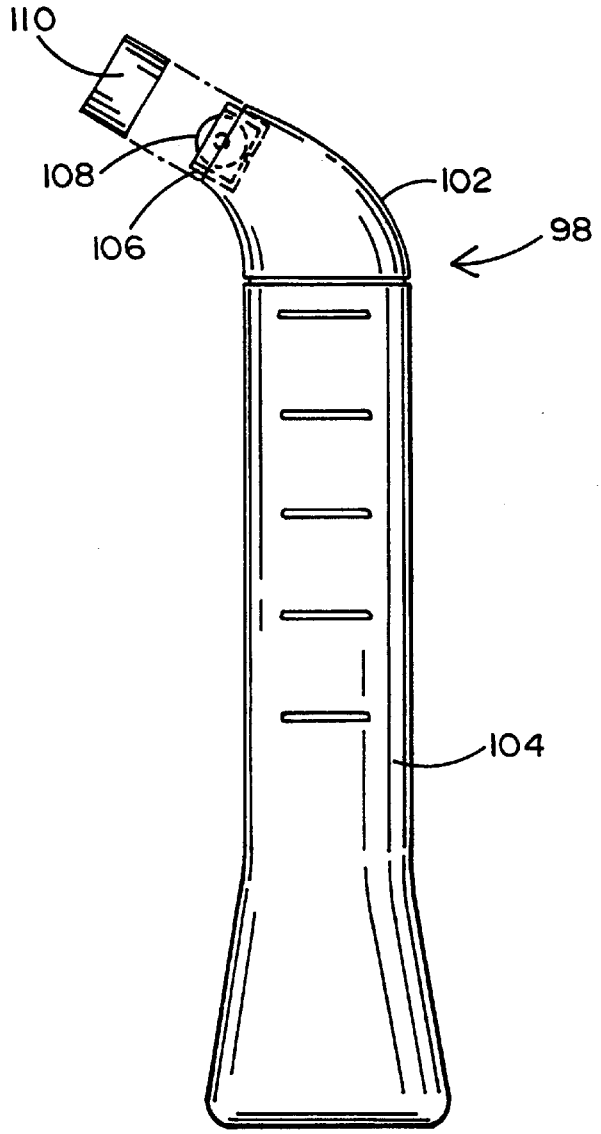
FIG. 13 is a side view of an embodiment of the applicator of this invention employing a dispensing head similar to that shown in FIGS. 1 and 6, but with a substantially rigid reservoir and an outer extension sleeve.
Figure 14:
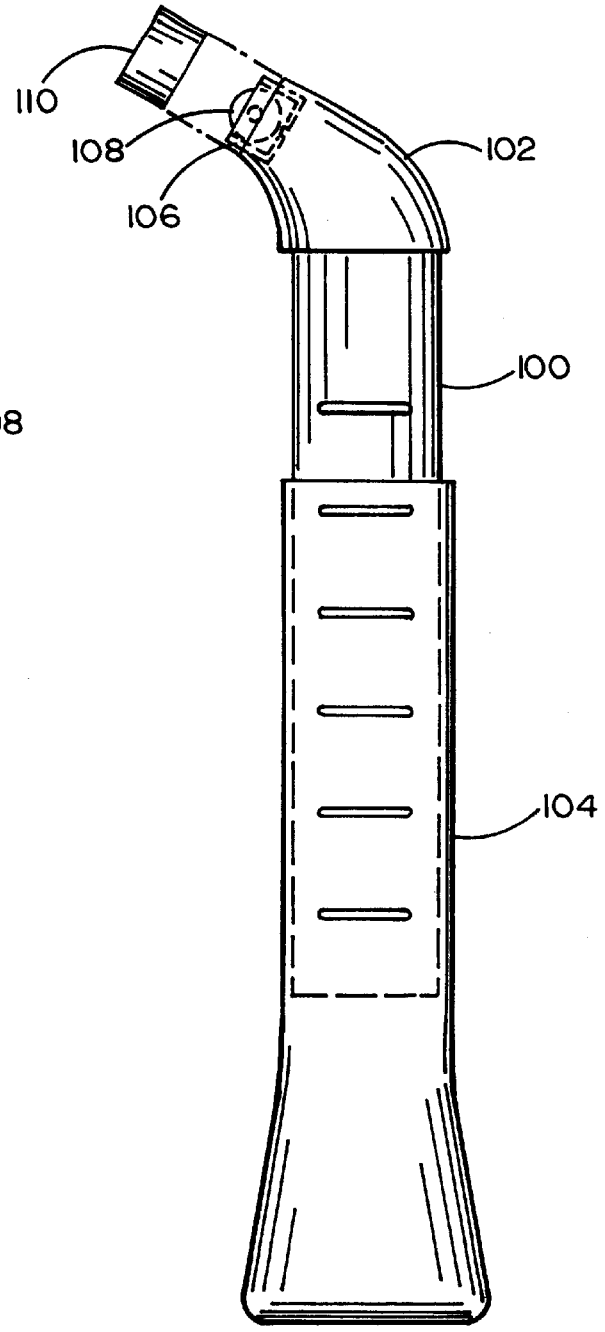
FIG. 14 is similar to FIG. 13 but with the extension sleeve partly extended.

FIGS. 13 and 14 show an applicator 98 which includes a reservoir 100. The reservoir 100 may be of rectangular cross-section. In FIG. 14, the rectangular cross-section is shown with the narrow wall toward the viewer. The rectangular walls generally define the axis of the structure. The reservoir 100 is closed at the bottom. Rectangular telescoping extender 104 is sized so that it engages around the reservoir. It can be moved from the non-telescoped position shown in FIG. 13 to a telescoped position shown in FIG. 14. In fact, in FIG. 14, the telescoping extender is not fully telescoped, but is shown partly extended in order to conserve drawing space. The telescoping extender can be pulled down so that a small amount of overlap remains. Stops are provided to limit extension and lock and unlock the extender in the extended position. The extender 104 acts for the same purposes as previously described, to permit extending the overall length of the applicator for convenient application of the material being dispensed. The direction of telescoping defines the axis.

The dispensing head 102 may be formed integrally with the reservoir 100 or may be attached thereto by means of a snap on fit. The upper portion of the dispensing head 102 receives a roller basket 106 with a roller 108 therein. Cap 110 is removably attached over the roller to press the roller against its dispensing opening. This structure is the same as illustrated and described in FIGS. 2 through 5. The angle of the front face of the box 106 such that a normal to the plane intersects the axis of the reservoir at about 120 degrees. This permits a convenient application of material to the surface by manual manipulation of the applicator. When the material is to be applied to a surface which is difficult to reach, the telescoping extender can move the dispensing roller farther away from the manual grasp on the extender to make such application more convenient.

This invention has been described in its presently preferred best mode and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An applicator comprising:

a reservoir for containing a fluid suitable for external body application for health and/or beauty purposes, said reservoir having an axis, said reservoir having an outlet, said reservoir being configured so that fluid therein can be dispensed from said reservoir through said outlet;

a dispenser head attached to said reservoir, said dispenser head having a body thereon by which said dispenser head is attached to said reservoir, said dispensing head having side walls and end walls defining a basket and said body forming the bottom of said basket, said dispenser head having a dispensing passage therethrough extending from said reservoir outlet into said basket, said dispenser head having a face, said face lying in a plane which intersects said axis at an acute angle;

a rolling member in said basket configured for rotation about an axis within said basket, said rolling member lying adjacent said dispensing passage to receive fluid material from said reservoir, said rolling member being configured and positioned to apply the fluid material from said reservoir onto a selected body surface and being positioned within said basket so as to limit distribution of fluid material from said rolling member in a direction other than out of an open end of said basket.

2. The applicator of claim 1 wherein said rolling member is a truncated conical surface.

3. The applicator of claim 1 wherein said rolling member is a sphere.

4. The applicator of claim 3 wherein said rolling member comprises a plurality of spheres.

5. The applicator of claim 1 wherein there is a piston in said reservoir and a driver connected to said piston to urge said piston toward said dispenser head to expel fluid material from said reservoir to said dispenser head.

6. The applicator of claim 1 wherein said reservoir has flexible reservoir walls so that said reservoir can be squeezed to expel material therefrom to said dispenser head.

7. The applicator of claim 1 further including a telescopic extender telescopically slidable and mounted on said reservoir, said telescopic extender being configured to be manually grasped so that when extended, manual grasp is farther away from said dispenser head than when said telescopic extender is unextended.

8. The applicator of claim 7 wherein said telescoping member comprises a tube slidably engaged on the exterior of said reservoir to move in a direction generally along the axial direction so that the length of said reservoir can be effectively lengthened.

9. The applicator of claim 7 wherein said reservoir has an interior tube which is open to the bottom of said reservoir opposite said dispensing opening of said reservoir and there is a telescoping member slidably mounted in said interior tube.

10. An applicator comprising:

a reservoir for containing fluid materials suitable for external body application for health and/or beauty purposes, said reservoir having an axis, said reservoir having an outlet, said reservoir being structured so that fluid materials suitable for external body application in said reservoir can be expelled from said outlet;

a dispenser head mounted on said reservoir, said dispenser head having an opening therethrough, said opening in said dispenser head being in communication with said outlet from said reservoir so as to permit fluid material suitable for external body application within said reservoir to be dispensed from said reservoir, said dispenser head having a face, said face being defined by spaced side walls and spaced end walls defining a basket with said opening in said dispenser head being in the bottom of said basket, a plane lying in said face, a line perpendicular to said plane intersecting said axis at an acute angle, a roller within said basket, said roller extending from said basket to extend beyond said plane defining said face of said dispenser head, said opening through the dispenser head being positioned to deposit fluid material from said reservoir onto said roller for external application to a selected area of the body and said walls of said basket limiting distribution of said fluid material to a position beyond said plane to avoid splashing of the fluid material; and a telescopic extender slidably mounted with respect to said reservoir for a sliding motion generally along said axis, said telescopic extender being manually graspable so that when in an extended position, the manually graspable handle on said telescopic extender is farther away from said dispenser head than when unextended.

11. The applicator of claim 10 wherein said angle of intersection between said line perpendicular to said plane and said axis is substantially 60 degrees.

12. The applicator of claim 10 wherein said telescopic extender is slidable within said reservoir.

13. The applicator of claim 10 further including structure for expelling fluid from said reservoir into said dispenser head.

14. The applicator of claim 13 wherein said structure for expelling fluid material from said reservoir comprises a piston in said reservoir and an external actuator to move said piston toward said applicator head.

* * * * *

UNITED STATES PATENT AND TRADEMARK OFFICE

CERTIFICATE OF CORRECTION

PATENT NO. : 6,244,776 B1
DATED : June 2, 2001
INVENTOR(S) : Lien L. Wiley

It is certified that error appears in the above-identified patent and that said Letters Patent is hereby corrected as shown below:

Title page,
Inventor, the correct name of the inventor is -- Lien L. Wiley --

Signed and Sealed this

Nineteenth Day of February, 2002

*Attest:*

*Attesting Officer*

JAMES E. ROGAN
*Director of the United States Patent and Trademark Office*